US007950534B2

(12) United States Patent
Kao

(10) Patent No.: US 7,950,534 B2
(45) **Date of Patent: *May 31, 2011**

(54) HAND TOOL RACK

(76) Inventor: Jui-Chien Kao, Tali (TW)

( * ) Notice: Subject to any disclaimer, the term of this patent is extended or adjusted under 35 U.S.C. 154(b) by 105 days.

This patent is subject to a terminal disclaimer.

(21) Appl. No.: 12/453,903

(22) Filed: May 27, 2009

(65) Prior Publication Data

US 2010/0300996 A1 Dec. 2, 2010

(51) Int. Cl.
*A47F 7/00* (2006.01)

(52) U.S. Cl. ..... 211/70.6; 211/94.01; 248/309.1

(58) Field of Classification Search ..... 211/60.1, 211/70.6, 94, 62, 63, 64, 65, 66, 67, 68, 69, 211/69.1, 96.8, 69.9, 70.2, 70.3, 70.8, 94.01; 248/225.1, 229.16, 276.1, 110, 200, 309.1, 248/316.1; D8/354, 373, 380, 394, 395; 206/372, 373, 349, 378, 483, 480, 478
See application file for complete search history.

(56) References Cited

U.S. PATENT DOCUMENTS

| | | | | | |
|---|---|---|---|---|---|
| 2,161,855 | A * | 6/1939 | Copell | 248/316.7 |
| 2,707,052 | A * | 4/1955 | Brown | 211/65 |
| 2,712,167 | A * | 7/1955 | Blanchard | 24/569 |
| 2,754,974 | A * | 7/1956 | Larson | 211/70.6 |
| 2,974,804 | A * | 3/1961 | Maro | 211/70.6 |
| 3,138,414 | A * | 6/1964 | La Pollo | 312/207 |
| 4,678,151 | A * | 7/1987 | Radek | 248/223.41 |
| 4,828,002 | A * | 5/1989 | Ashby | 160/38 |
| 4,869,378 | A * | 9/1989 | Miller | 211/94.01 |
| 5,284,245 | A * | 2/1994 | Slivon et al. | 206/378 |
| 5,836,055 | A * | 11/1998 | Cooper | 24/339 |
| 6,119,317 | A * | 9/2000 | Pfister | 24/514 |
| 6,932,226 | B2 * | 8/2005 | Hardy | 211/119.003 |
| 7,434,700 | B2 * | 10/2008 | Kao | 211/70.6 |
| D582,259 | S * | 12/2008 | DeBiasio, Jr. | D8/363 |
| 7,523,832 | B2 * | 4/2009 | Kao | 211/70.6 |
| 7,694,832 | B2 * | 4/2010 | Kao | 211/70.6 |
| 7,717,278 | B2 * | 5/2010 | Kao | 211/70.6 |
| 7,861,871 | B2 * | 1/2011 | Kao | 211/70.6 |
| 2004/0118798 | A1 * | 6/2004 | Spiers et al. | 211/89.01 |
| 2007/0017886 | A1 * | 1/2007 | Kao | 211/94.01 |
| 2008/0023420 | A1 * | 1/2008 | Kao | 211/70.6 |
| 2008/0041800 | A1 * | 2/2008 | Kao | 211/70.6 |
| 2009/0184070 | A1 * | 7/2009 | Kao | 211/70.6 |

* cited by examiner

*Primary Examiner* — Darnell M Jayne
*Assistant Examiner* — Kimberley S Wright
(74) *Attorney, Agent, or Firm* — Bacon & Thomas, PLLC

(57) ABSTRACT

A hand tool rack has an elongated base bracket and multiple clamping elements. The base bracket has a baseboard and a rail bracket. The rail bracket is formed on and protrudes from the baseboard. The clamping elements are movably mounted on the rail bracket and each clamping element has a clamping arm and a tool mount. The clamping arm is slidably mounted and clamps on the rail bracket and has two holders. The tool mount is formed on and protrudes from the clamping arm and has a tool hole, a mounting slit and two recesses. The tool hole is formed through an upper surface and a lower surface of the tool mount. The mounting slit is formed through the upper surface, a front surface and the lower surface of the tool mount and communicates with the tool hole. The recesses are respectively formed in the sidewalls of the tool mount.

10 Claims, 12 Drawing Sheets

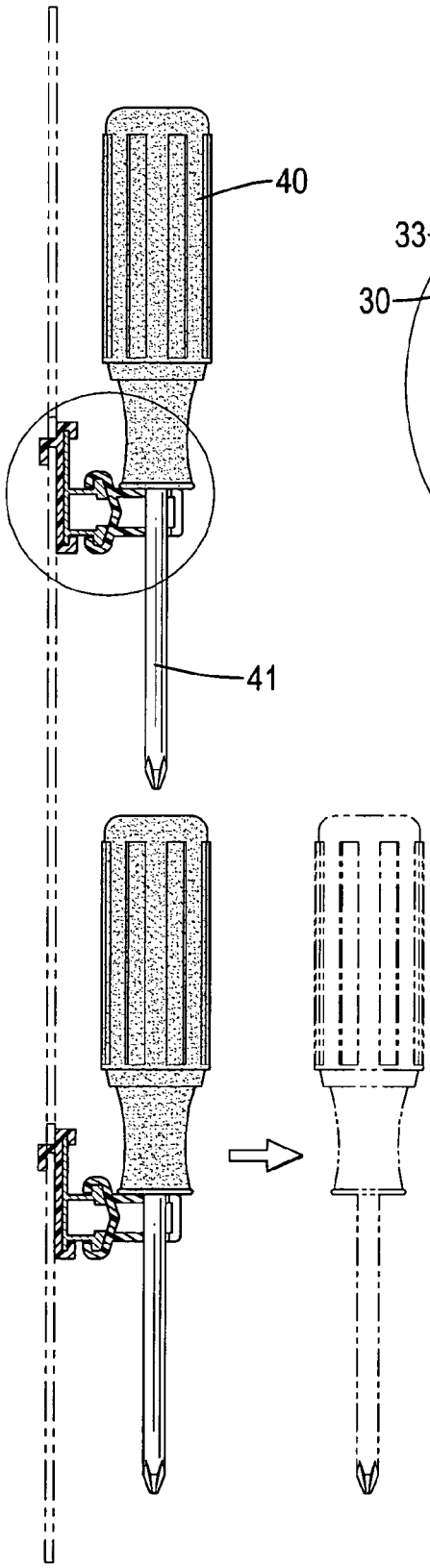
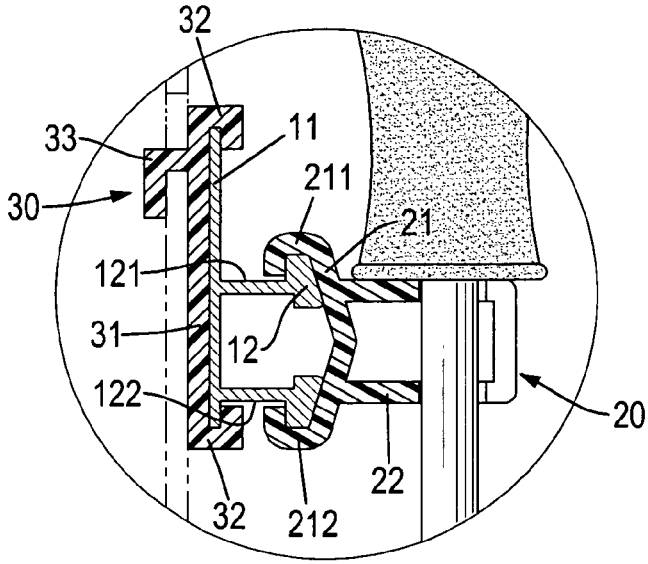
FIG.4B
FIG.4A

HAND TOOL RACK

BACKGROUND OF THE INVENTION

1. Field of the Invention

The present invention relates to a tool rack, and more particularly to a hand tool rack that can be mounted on a wall easily and a distance between two adjacent hand tools can be adjusted.

2. Description of the Prior Art

A conventional hand tool rack is suspended on a wall, so that hand tools can be organized to facilitate work efficiency and prevent loss of tools. The conventional hand tool rack is provided with an elongated rack adapted for connection to a wall and multiple clamping elements firmly formed on the elongated rack. Each clamping element defines a through hole to hold a shank of the hand tool.

However, the clamping elements are firmly mounted on the rack and cannot be moved to maximize utility of available space on the rack and when the rack is mounted on the wall, only limited space is available for inserting hand tools into the through holes in the clamping elements.

To overcome the shortcomings, the present invention tends to provide a hand tool rack to mitigate the aforementioned problems.

SUMMARY OF THE INVENTION

The main objective of the present invention is to provide a hand tool rack that can be mounted on a wall easily and a distance between two adjacent hand tools can be adjusted.

The hand tool rack in accordance with the present invention has an elongated base bracket and multiple clamping elements. The base bracket has a baseboard and a rail bracket. The rail bracket is longitudinally formed on and protrudes from the baseboard. The clamping elements are movably mounted on the rail bracket of the base bracket and each clamping element has a clamping arm and a tool mount. The clamping arm is mounted slidably and clamps on the rail bracket and has an upper holder and a lower holder. The tool mount is formed on and protrudes from the clamping arm and has a tool hole, a mounting slit and two recesses. The tool hole is formed through an upper surface and a lower surface of the tool mount. The mounting slit is formed through the upper surface, a front surface and the lower surface of the tool mount and communicates with the tool hole. The recesses are respectively formed in the sidewalls of the tool mount.

Other objects, advantages and novel features of the invention will become more apparent from the following detailed description when taken in conjunction with the accompanying drawings.

BRIEF DESCRIPTION OF THE DRAWINGS

FIG. 4A shows operational side views in partial section of the clamping element of the hand tool rack in FIG. 1, showing removal of the hand tool from the clamping element;

FIG. 4B is an enlarged side view in partial section of the clamping element in FIG. 4A;

DETAILED DESCRIPTION OF THE PREFERRED EMBODIMENT

Figure 1:
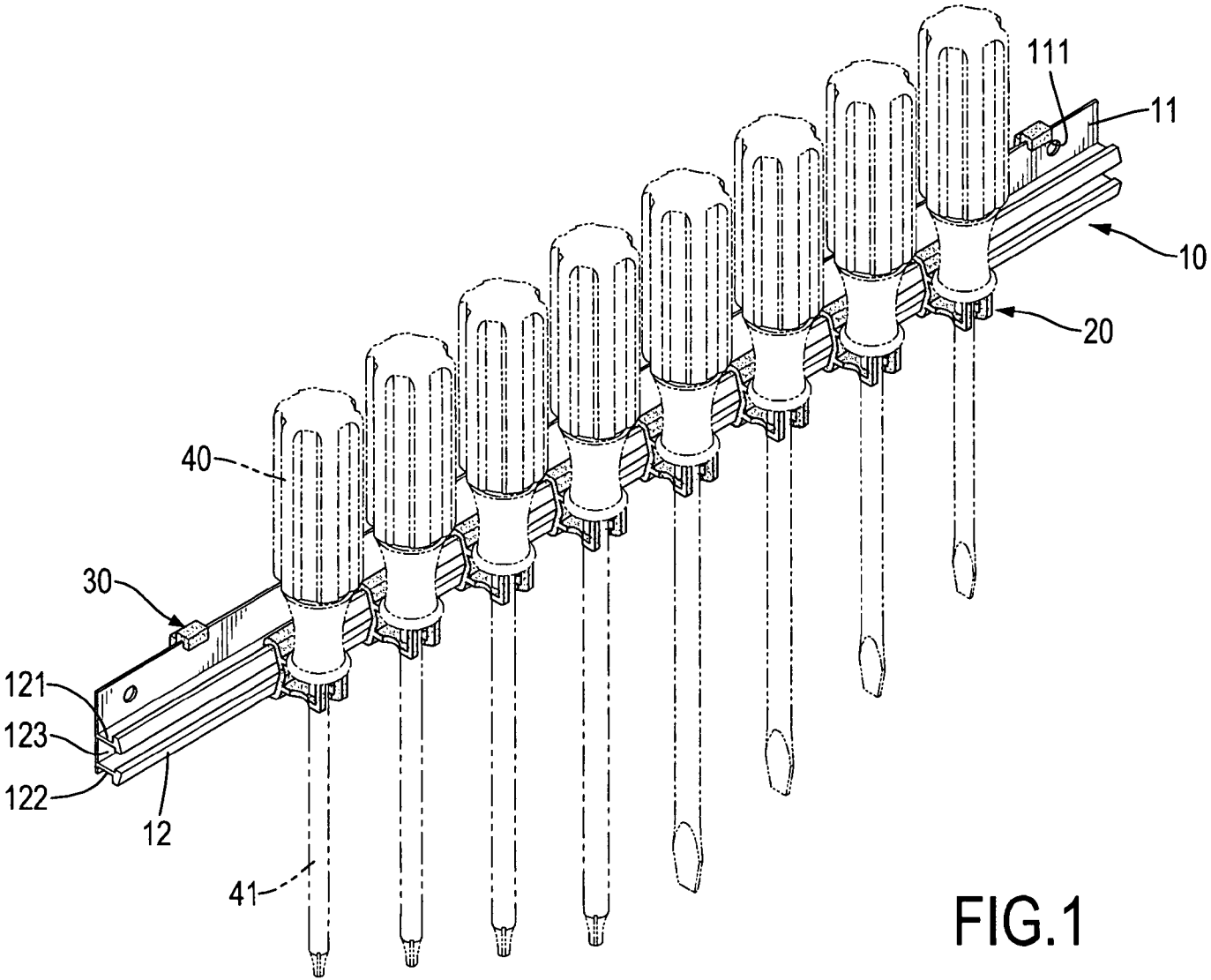
FIG. 1 is a perspective view of a hand tool rack in accordance with the present invention, showing hand tools clamped by the rack in phantom lines.

With reference to FIGS. 1 to 4B, 9, 11 and 12, a hand tool rack in accordance with the present invention for holding hand tools (40) has an elongated base bracket (10), multiple clamping elements (20, 20A, 20B) and two hangers (30).

The base bracket (10) may be hung on a surface such as a wall or a tool cart and has a baseboard (11, 11B) and a rail bracket (12, 12B).

The baseboard (11, 11B) may be elongated and has a front surface, a rear surface, a top edge, a bottom edge, two ends and two bolt holes (111, 111B). The bolt holes (111, 111B) are respectively formed through the surfaces of the baseboard (11, 11B) near the ends of the baseboard (11, 11B).

Figure 11:
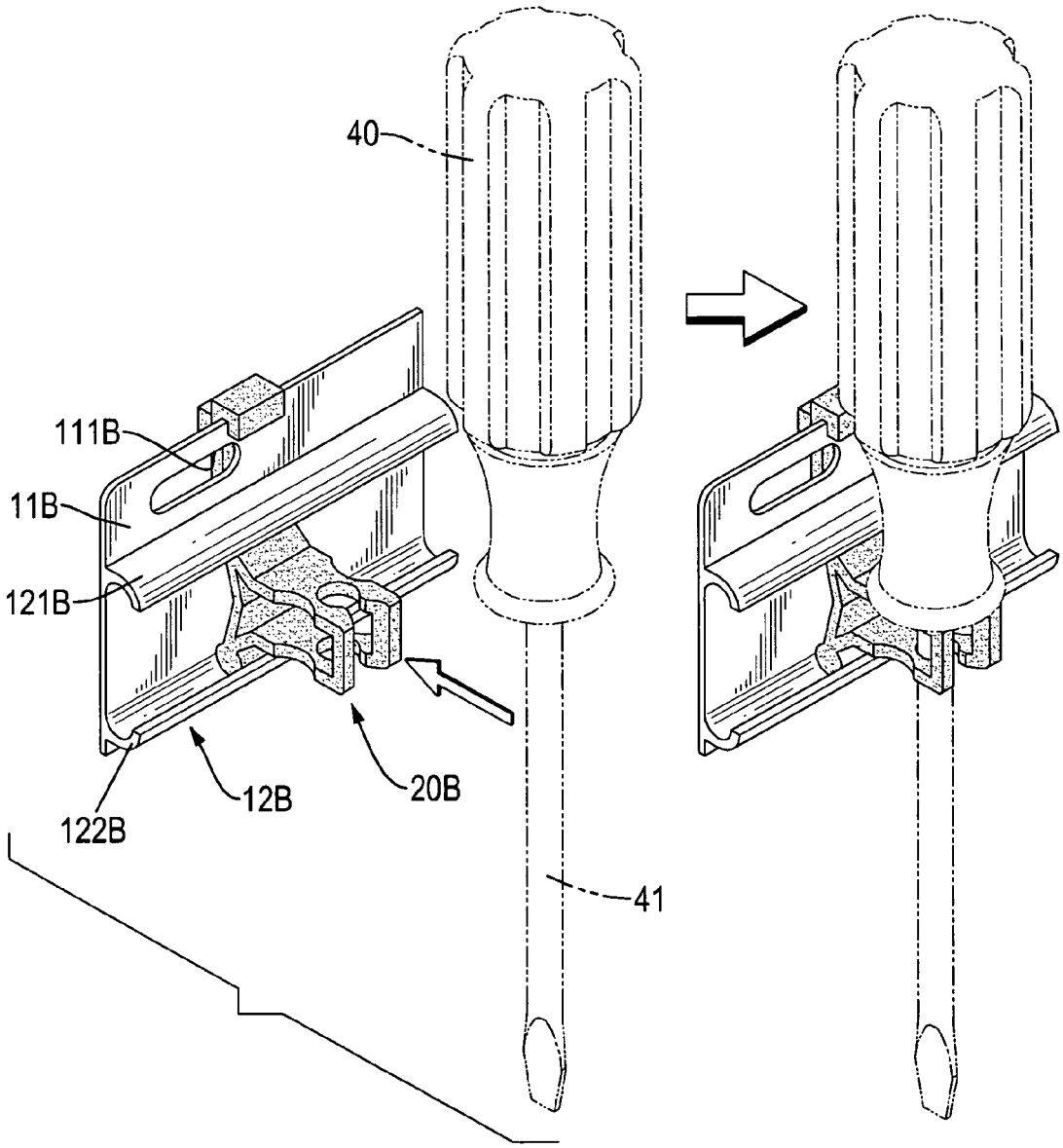
FIG. 11 is an operational perspective view showing a portion of a third embodiment of a hand tool rack in accordance with the present invention, showing insertion of a hand tool in a clamping element.

The rail bracket (12, 12B) is longitudinally formed on and protrudes from the front surface of the baseboard (11, 11B) and has an upper rail (121, 121B), a lower rail (122, 122B) and a channel (123). The upper rail (121, 121B) is longitudinally formed on and protrudes from the front surface of the baseboard (11, 11B) near the bolt holes (111, 111B). The lower rail (122, 122B) is longitudinally formed on and protrudes from the front surface of the baseboard (11, 11B) and is parallel to the upper rail (121, 121B). The guides (121, 121B, 122, 122B) of the rail bracket (12, 12B) may be panel or hook shaped as shown in FIGS. 4B and 11. The channel (123) is formed in the rail bracket (12) between the guides (121, 122) and the front surface of the baseboard (11) to allow elastic deformation of the guides (121, 122) of the rail bracket (12).

Figure 2:
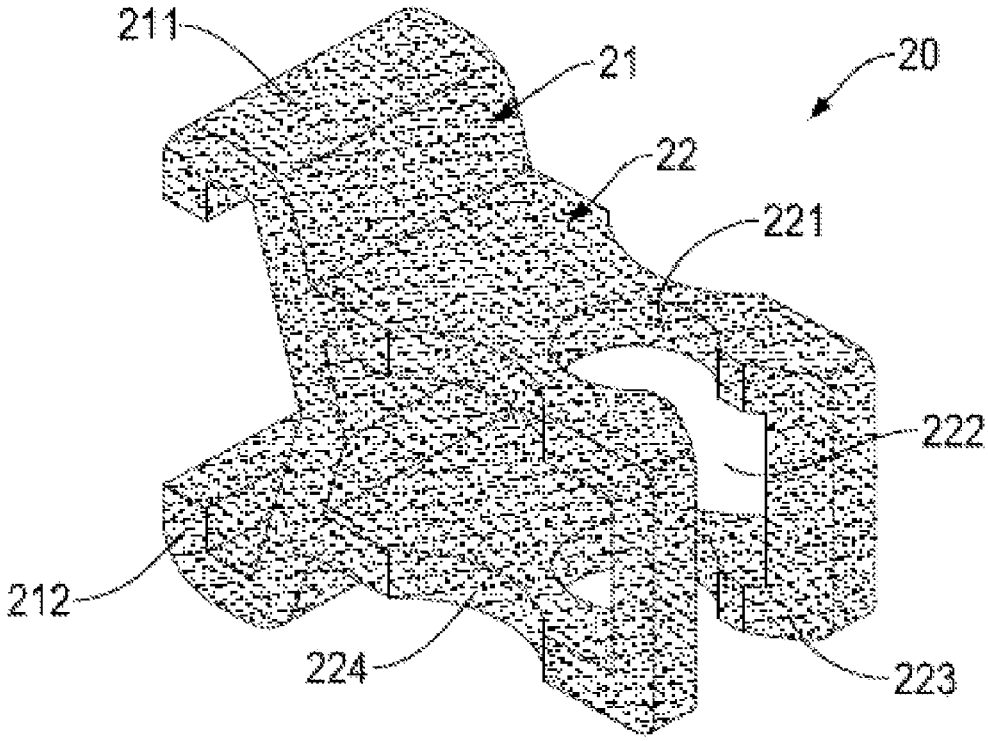
FIG. 2 is a perspective view of a first embodiment of a clamping element of the hand tool rack in FIG. 1.
Figure 9:
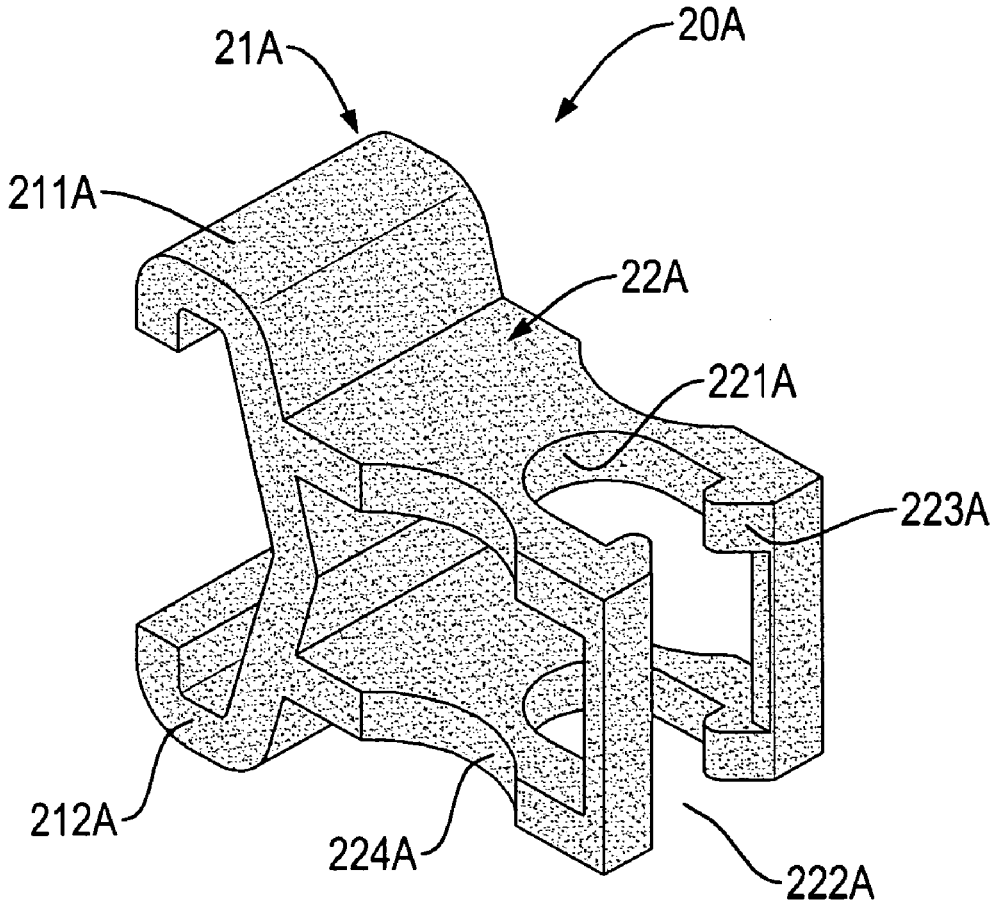
FIG. 9 is a perspective view of the second embodiment of the clamping element in FIG. 8.
Figure 12:
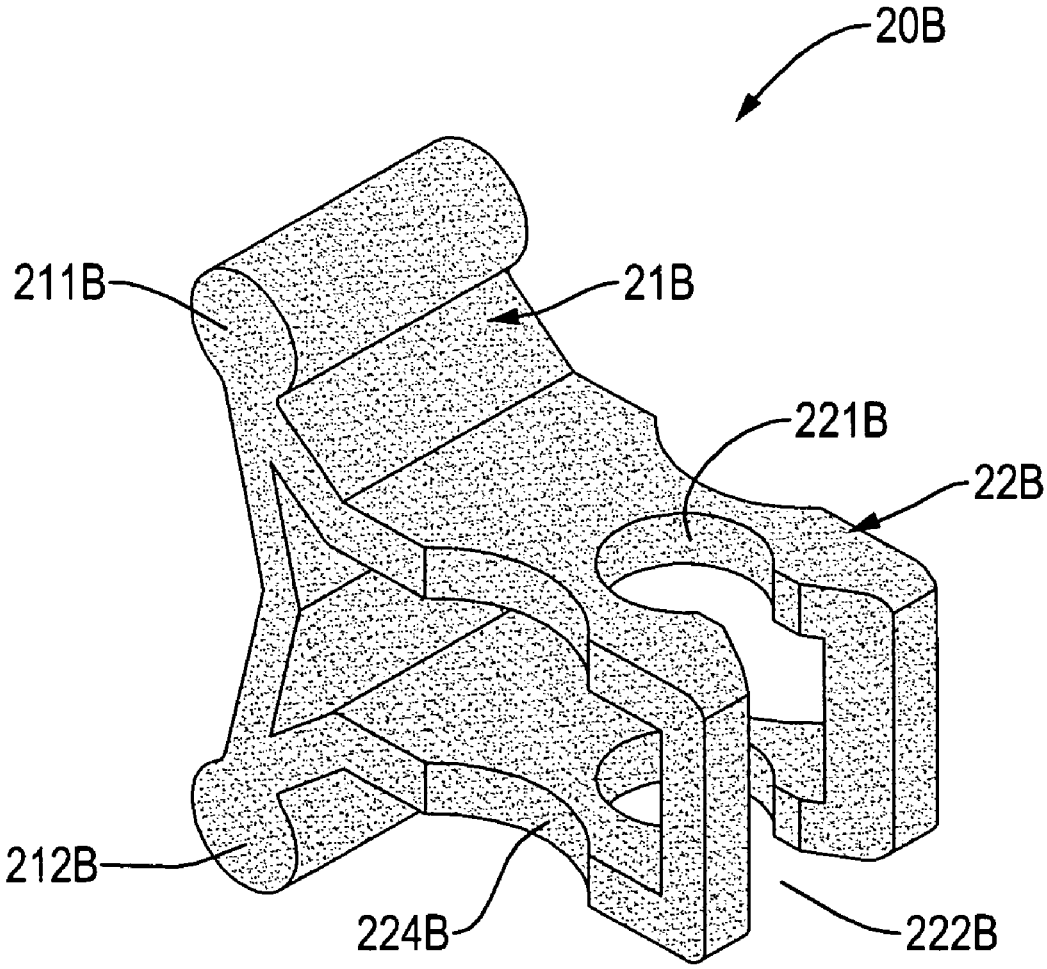
FIG. 12 is a perspective view of the clamping element in FIG. 11.

With further reference to FIGS. 2, 9 and 12, the clamping elements (20, 20A, 20B) are movably mounted on the rail bracket (12, 12B) of the base bracket (10) and each clamping element (20, 20A, 20B) is hollow and has a rear end, a front end, a clamping arm (21, 21A, 21B) and a tool mount (22, 22A, 22B).

The clamping arm (21, 21A, 21B) is formed on the rear end of the clamping element (20, 20A, 20B), is mounted slidably and clamps on the rail bracket (12, 12B) of the base bracket (10) and has an upper holder (211, 211A, 211B) and a lower holder (212, 212A, 212B). The holders (211, 211A, 211B, 212, 212A, 212B) are respectively clamped on the guides (121, 121B, 122, 122B) of the rail bracket (12, 12B) and each holder (211, 211A, 211B, 212, 212A, 212B) may be a hook or a cylinder to clamp on or mount in the guides (121, 121B, 122, 122B) of the rail bracket (12, 12B).

The tool mount (22, 22A, 22B) is formed on the front end of the clamping element (20, 20A, 20B), is formed on and protrudes from the clamping arm (21, 21A, 21B) for holding hand tools (40) and has an upper surface, a lower surface, a front surface, two sidewalls, a tool hole (221, 221A, 221B), a mounting slit (222, 222A, 222B), a guiding face (223, 223A) and two recesses (224, 224A, 224B). The sidewalls of the tool mount (22, 22A, 22B) are parallel to one another.

The tool hole (221, 221A, 221B) may be circular or U shaped, is formed through the upper surface and the lower surface of the tool mount (22, 22A, 22B) near the front surface.

The mounting slit (222, 222A, 222B) is formed through the upper surface, the front surface and the lower surface of the tool mount (22, 22A, 22B) and communicates with the tool hole (221, 221A, 221B).

The guiding face (223, 223A) is formed on the front surface of the tool mount (22, 22A) to guide and aid mounting of the hand tools (40) in the tool hole (221, 221A) via the mounting slit (222, 222A).

Figure 7:
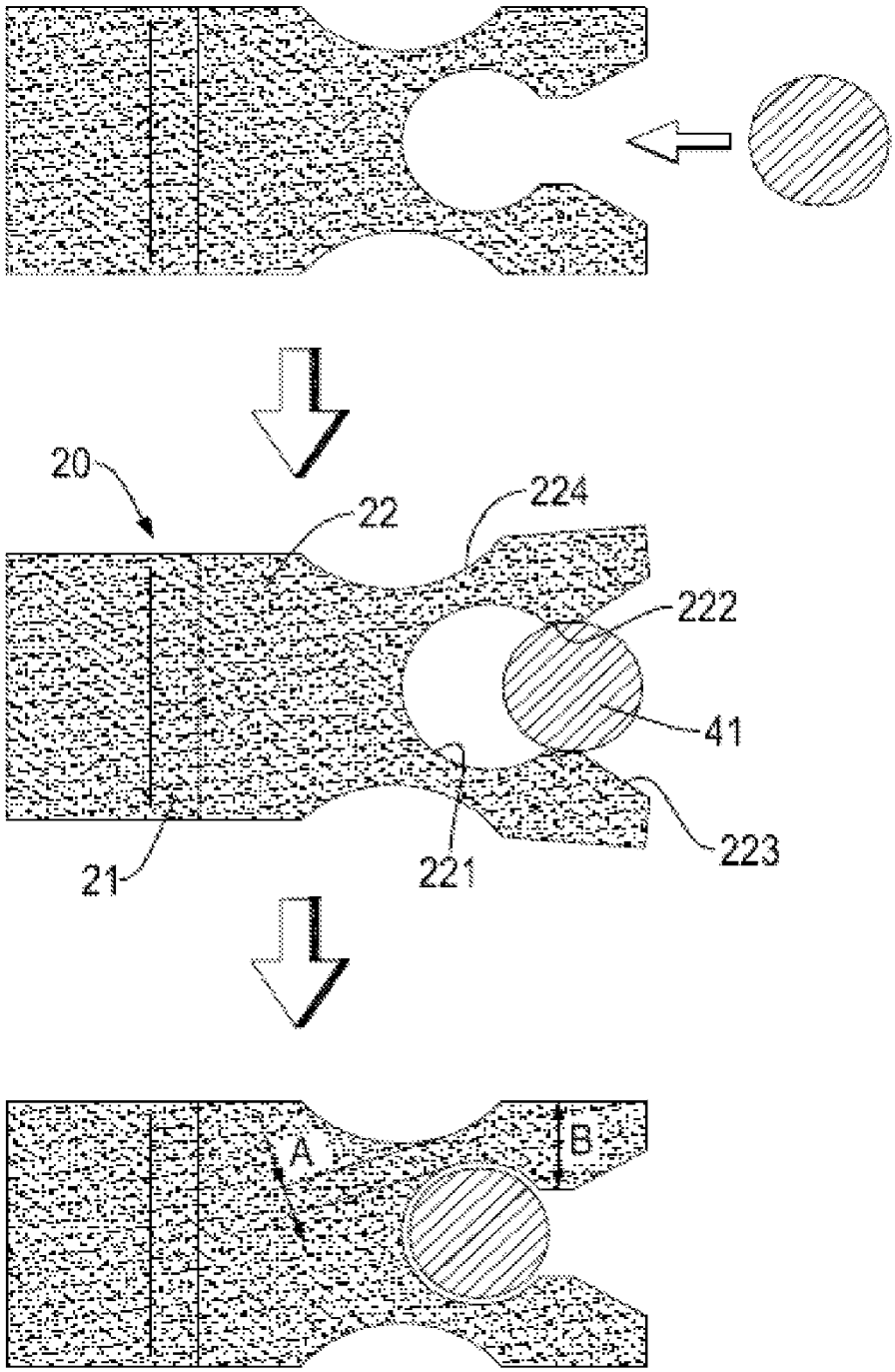
FIG. 7 is operational top views in partial section showing insertion of the hand tool in the clamping element in FIG. 6.

The recesses (224, 224A, 224B) may be arc shaped and are respectively formed in the sidewalls of the tool mount (22, 22A, 22B) for allowing the tool mount (22, 22A, 22B) to undergo elastic deformation. With reference to FIG. 7, the minimum distance between the recess (224, 224A, 224B) and the tool hole (221, 221A, 221B) is A, the minimum distance between the sidewall of the tool mount (22, 22A, 22B) and the mounting slit (222, 222A, 222B) is B and A is smaller than B, to allow elastic deformation of the mounting slit (222, 222A, 222B) of the tool mount (22, 22A, 22B).

Figure 3:
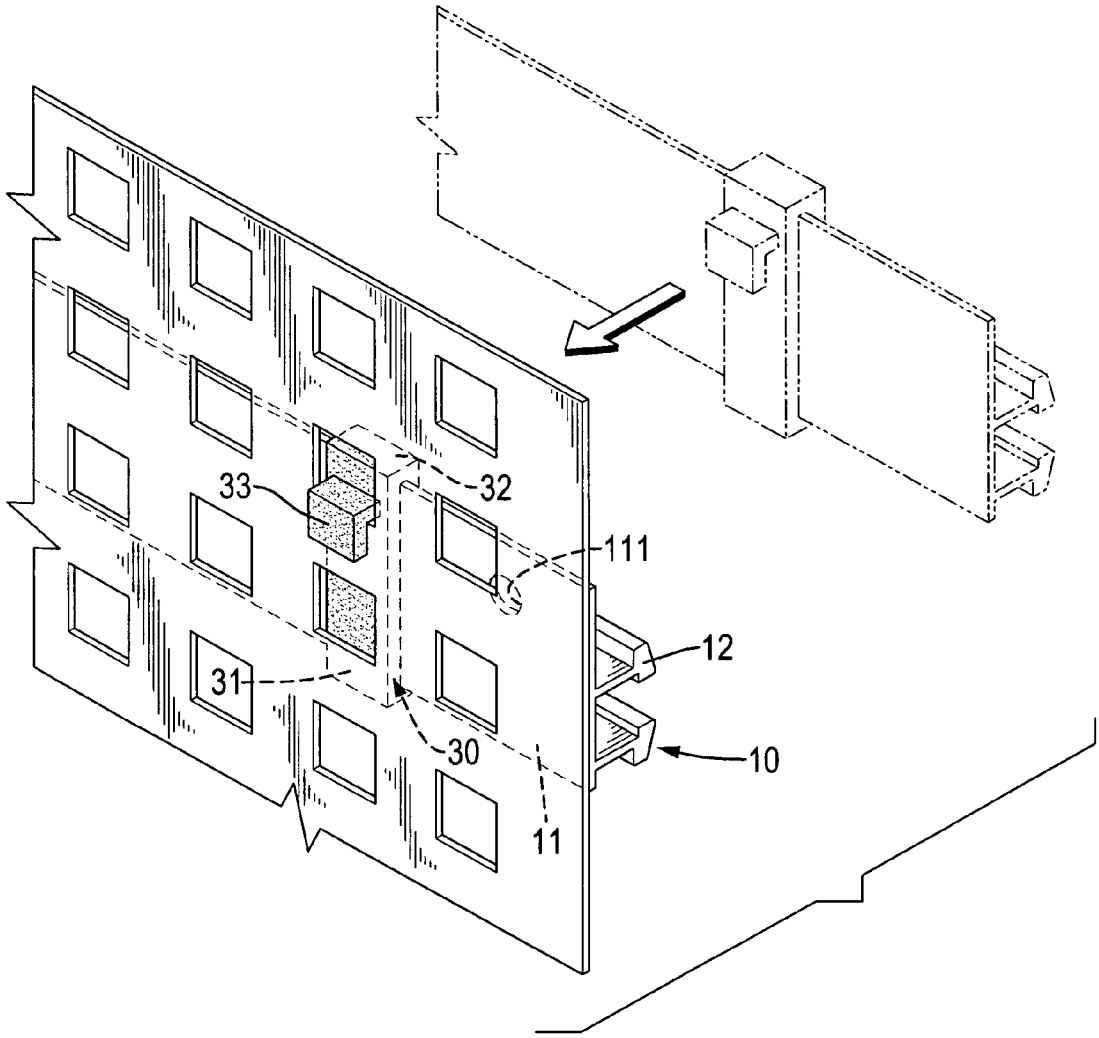
FIG. 3 is an operational perspective rear view of a base bracket of the hand tool rack in FIG. 1 mounted on a wall.

With reference to FIGS. 1, 3 and 4B, the hangers (30) are movably mounted on the base bracket (10) and each hanger (30) has a body (31), two mounting arms (32) and a hanging arm (33). The body (31) may be a panel and has a front side and a rear side. The mounting arms (32) are formed on and protrude from the front side of body (31) and are clamped on the top edge and the bottom edge of the baseboard (11). The hanging arm (33) is formed on and protrudes from the rear side of the body (31) for hanging on a wall.

Figure 5B:
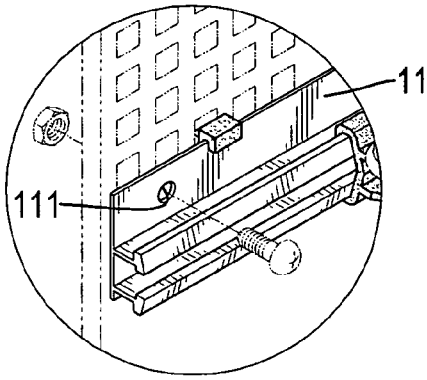
FIG. 5B is an enlarged perspective view of the hand tool rack in FIG. 5A.
Figure 5A:
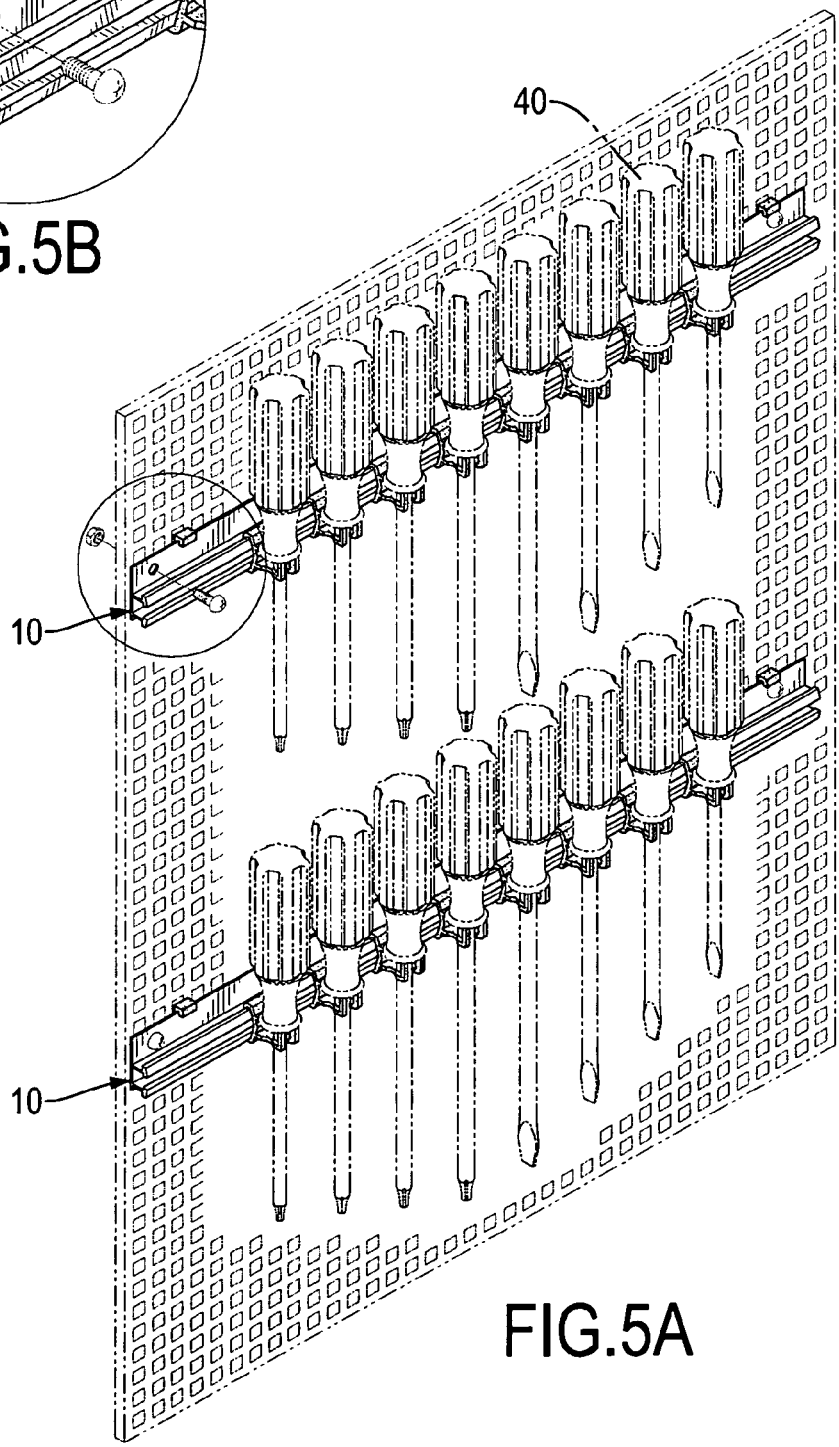
FIG. 5A is a perspective view of the hand tool rack in FIG. 1 mounted on a wall by threaded bolts.
Figure 6:
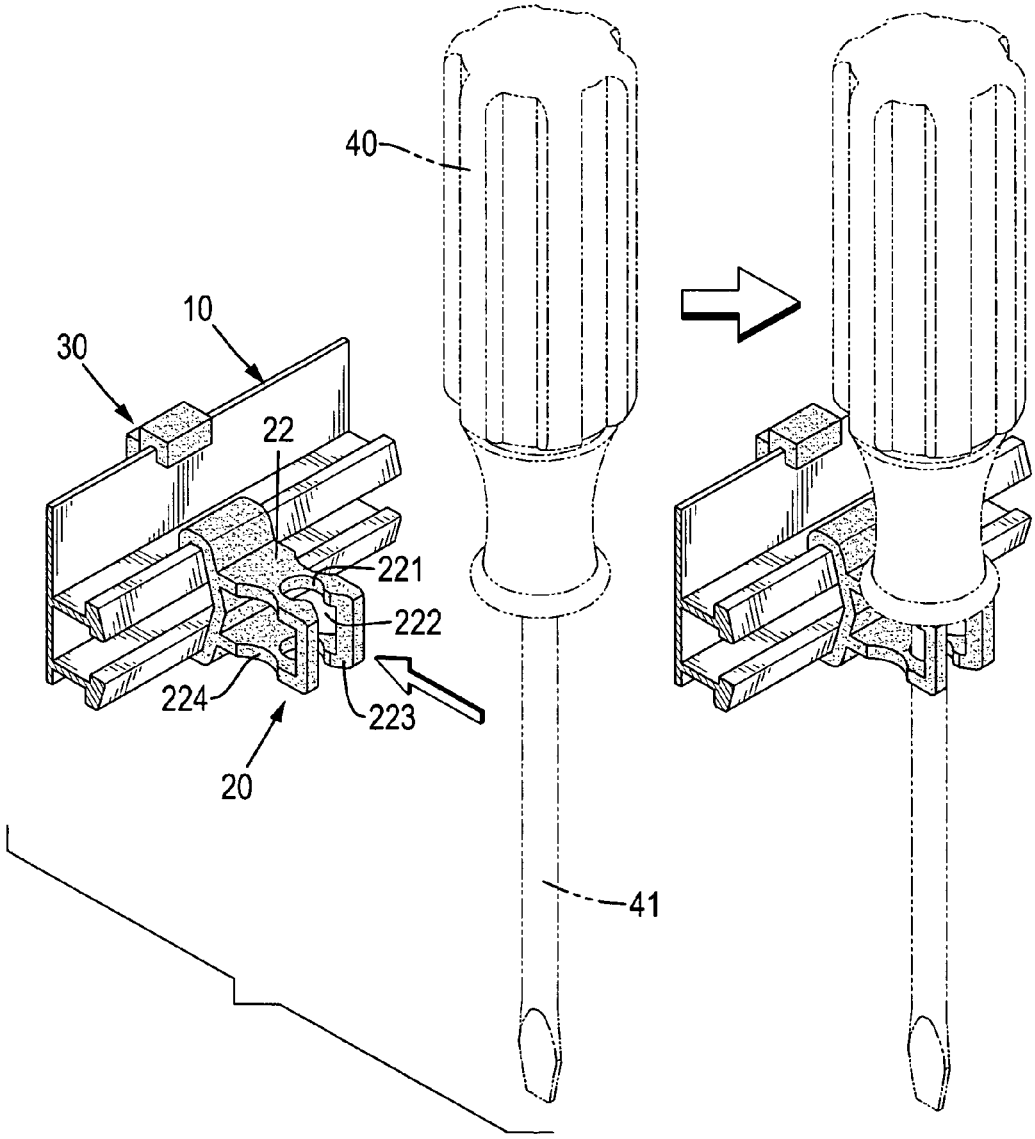
FIG. 6 shows operational perspective views of a portion of the hand tool rack in FIG. 1, showing insertion of the hand tool in the clamping element.

With reference to FIGS. 3, 5A and 5B, the base bracket (10) of the hand tool rack can be mounted on a wall by the hanging arms (33) of the hangers (30) for clamping hand tools (40). Furthermore, bolts are mounted through the bolt holes (111, 111B) of the baseboard (11, 11B) and fastened with nuts after the base bracket (10) of the hand tool rack has been mounted on the wall by the hangers (30), such that the base bracket (10) can be securely mounted on the wall. With reference to FIGS. 1, 6, 8 and 11, each clamping element (20, 20A, 20B) can be moved to change a position relative to the base bracket (10) with the clamping arm (21, 21A, 21B) of the clamping element (20, 20A, 20B) being slid relative to the guides (121, 122) of the rail bracket (12).

Figure 8:
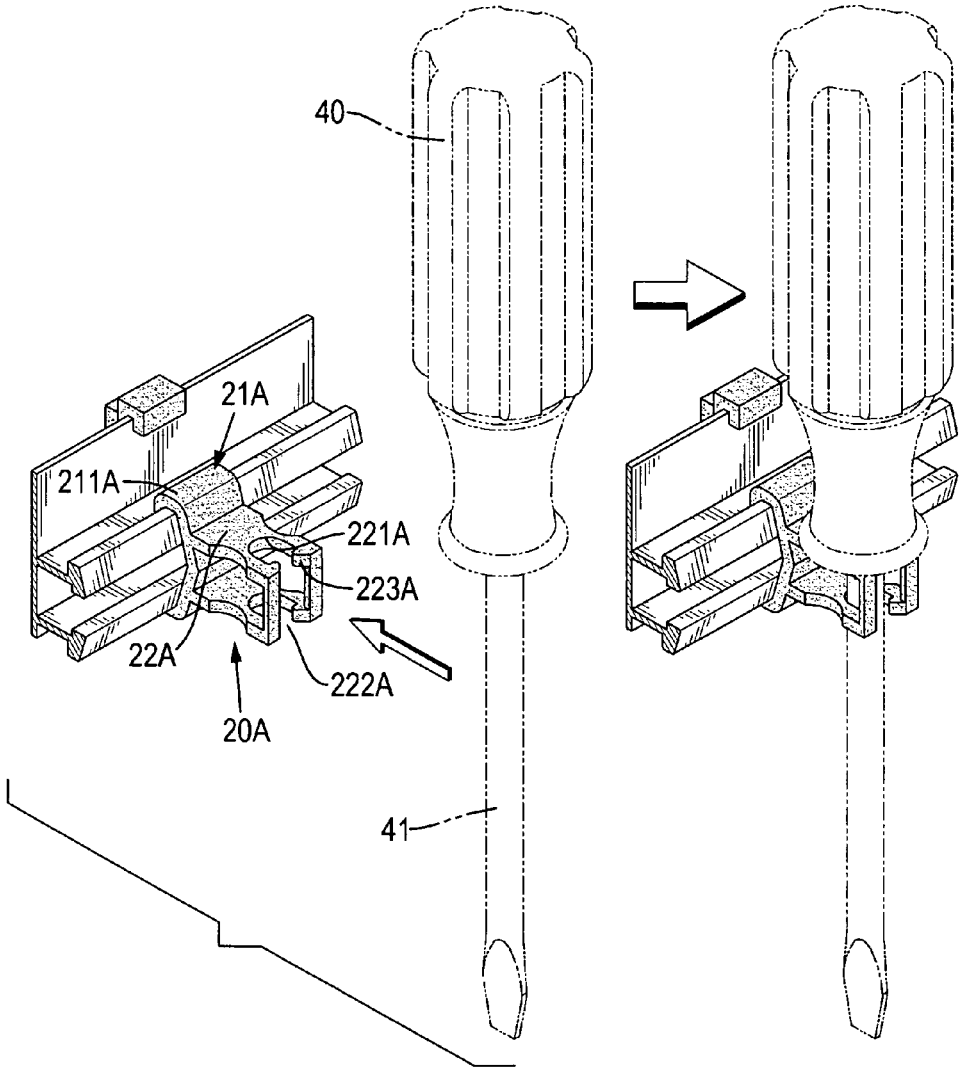
FIG. 8 is an operational perspective view showing a portion of a second embodiment of a hand tool rack in accordance with the present invention, showing insertion of the hand tool in a clamping element.
Figure 10:
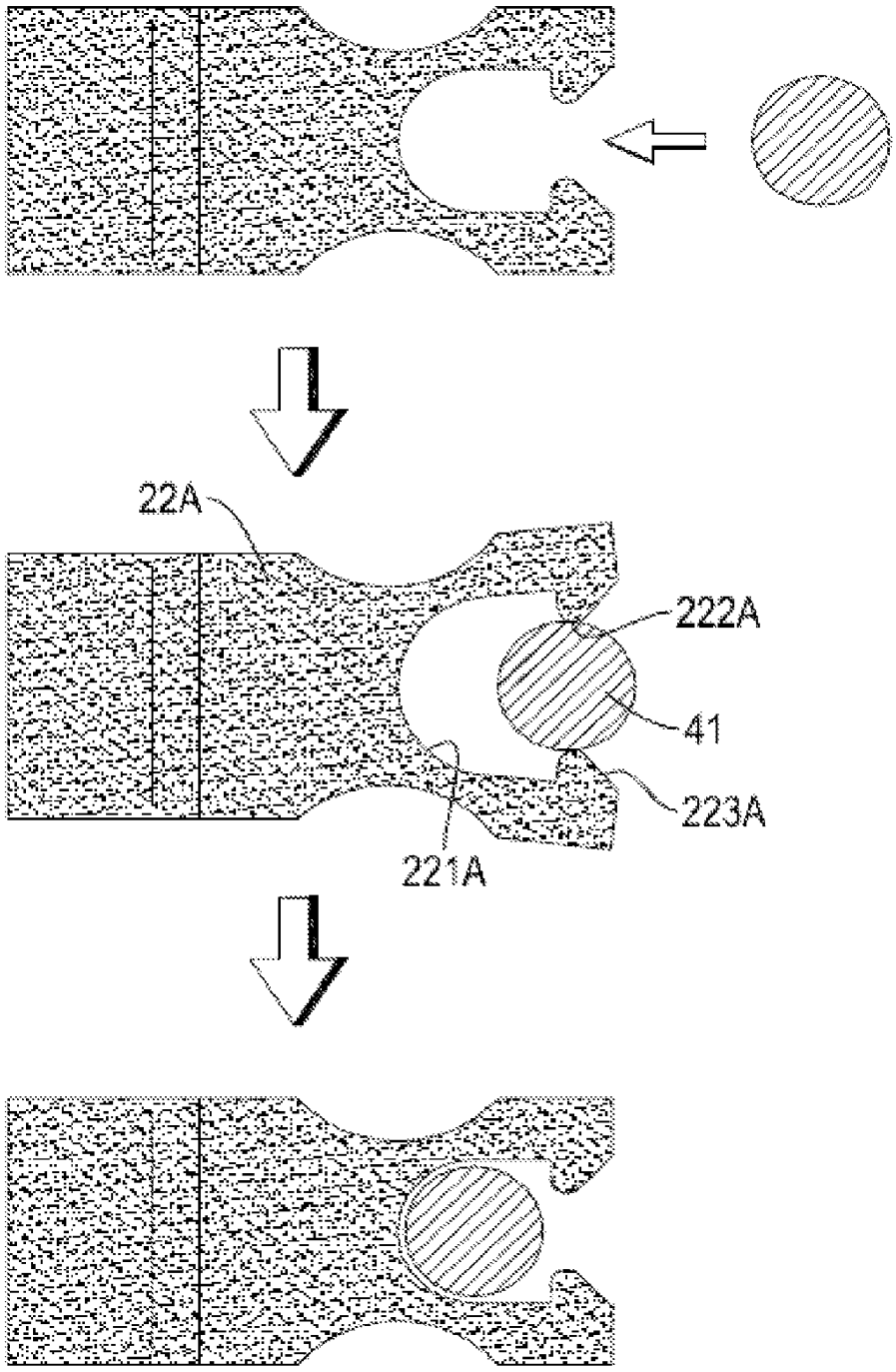
FIG. 10 shows operational top views in partial section of insertion of the hand tool in the clamping element in FIG. 9.

With reference to FIGS. 7, 10, and 11, the clamping element (20, 20A, 20B) may undergo elastic deformation when the hand tool (40) is mounted into the tool hole (221, 221A, 221B) via the mounting slit (222, 222A, 222B) to clamp the shank (41) of the hand tool (40) securely in the tool hole (221, 221A, 221B). In addition, the guiding face (223A) of the clamping element (20A) can provide a guiding effect to aid mounting the hand tool (40) in the tool hole (221A) via the mounting slit (222A). With further reference to FIGS. 1, 8 and 11, each clamping element (20, 20A, 20B) can be moved relative to the baseboard (11, 11B) by the clamping arm (21, 2121*b*) clamping on the rail bracket (12, 12B). Then, the distance between two adjacent clamping elements (20, 20A, 20B) can be adjusted to mount different kinds of hand tools (40). Furthermore, a minimum distance between the recess (224, 224A, 224B) and the tool hole (221, 221A, 221B) is smaller than a minimum distance between the sidewall of the tool mount (22, 22A, 22B) and the mounting slit (224, 224A, 224B), to allow elastic deformation of the mounting slit (222, 222A, 222B) of the tool mount (22, 22A, 22B).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hand tool rack comprising:

an elongated base bracket having a baseboard being elongated and having a front surface;

a rear surface;

a top edge;

a bottom edge;

two ends; and two bolt holes respectively formed through the surfaces of the baseboard near the ends of the baseboard; and a rail bracket longitudinally formed on and protruding from the front surface of the baseboard and having an upper rail longitudinally formed on and protruding from the front surface of the baseboard near the bolt holes; and a lower rail longitudinally formed on and protruding from the front surface of the baseboard and being parallel to the upper rail; and multiple clamping elements movably mounted on the base bracket and each clamping element having a rear end slidably mounted and clamping on the base bracket;

a front end; and a clamping arm formed on the rear end of the clamping element, slidably mounted and clamping on the upper and lower rails of the rail bracket and having an upper holder clamped on the upper rail of the rail bracket; and a lower holder clamped on the lower rail of the rail bracket; and a tool mount being hollow, formed on the front end of the clamping element and formed on and protruding from the clamping arm and having an upper surface;

a lower surface;

a front surface;

two sidewalls parallel to each other;

a tool hole formed through the upper surface and the lower surface of the tool mount;

a mounting slit formed through the upper surface, the front surface and the lower surface of the tool mount and communicating with the tool hole; and two recesses respectively formed in the sidewalls of the tool mount for allowing the tool mount to undergo elastic deformation;

wherein a minimum distance between the recess and the tool hole of each clamping element is smaller than a minimum distance between the sidewall of the tool mount and the mounting slit of the clamping element.

2. The hand tool rack as claimed in claim 1, wherein the hand tool rack has two hangers movably mounted on the base bracket and each hanger has a body being a panel and having a front side; and a rear side;

two mounting arms formed on and protruding from the front side of the body and clamped on the top edge and the bottom edge of the baseboard; and a hanging arm formed on and protruding from the rear side of the body.

3. The hand tool rack as claimed in claim 2, wherein the upper and lower rails of the rail bracket are panel shaped;

the rail bracket has a channel formed in the rail bracket between the upper and lower rails and the front surface of the baseboard; and the upper and lower holders of the clamping arm of each clamping element are hooks and are clamped on the upper and lower rails of the rail bracket.

4. The hand tool rack as claimed in claim 2, wherein the upper and lower rails of the rail bracket are hook shaped; and the upper and lower holders of the clamping arm of each clamping element are cylinders and are mounted in the upper and lower rails of the rail bracket.

5. The hand tool rack as claimed in claim 3, wherein the tool hole of the tool mount of each clamping element is formed through the upper surface and the lower surface of the tool mount near the front surface; and the recesses of the tool mount of each clamping element are arc shaped.

6. The hand tool rack as claimed in claim 4 wherein the tool hole of the tool mount of each clamping element is formed through the upper surface and the lower surface of the tool mount near the front surface; and the recesses of the tool mount of each clamping element are arc shaped.

7. The hand tool rack as claimed in claim 5, wherein the tool hole of the tool mount of each clamping element is circular; and the tool mount of each clamping element has a guiding face formed on the front surface of the tool mount.

8. The hand tool rack as claimed in claim 5, wherein the tool hole of the tool mount of each clamping element is U shaped; and the tool mount of each clamping element has a guiding face formed on the front surface of the tool mount.

9. The hand tool rack as claimed in claim 6, wherein the tool hole of the tool mount of each clamping element is circular; and the tool mount of each clamping element has a guiding face formed on the front surface of the tool mount.

10. The hand tool rack as claimed in claim 6, wherein the tool hole of the tool mount of each clamping element is U shaped; and the tool mount of each clamping element has a guiding face formed on the front surface of the tool mount.

* * * * *